United States Patent [19]

Brown

[11] 4,232,860

[45] Nov. 11, 1980

[54] PAPER FEEDER

[75] Inventor: Frank H. Brown, Norwich, N.Y.

[73] Assignee: Automecha Ltd., Oxford, N.Y.

[21] Appl. No.: 953,835

[22] Filed: Oct. 20, 1978

[51] Int. Cl.[3] ..... B65H 3/06; B65H 3/46

[52] U.S. Cl. ..... 271/119; 271/125

[58] Field of Search ..... 271/10, 118–120, 271/124, 125, 146, 161, 165–167, 202, 270, 254

[56] References Cited

U.S. PATENT DOCUMENTS

| | | | |
|---|---|---|---|
| 751,284 | 2/1904 | Harris | 271/120 |
| 2,394,410 | 2/1946 | Tascher | 271/119 X |
| 2,729,136 | 1/1956 | Feick et al. | 271/254 |
| 3,771,783 | 11/1973 | McInerny | 271/125 |
| 3,795,395 | 3/1974 | Ransom et al. | 271/119 X |
| 3,933,350 | 1/1976 | Mignano | 271/10 |
| 3,937,455 | 2/1976 | Hauser | 271/119 X |
| 3,944,210 | 3/1976 | McInerny | 271/118 |
| 3,991,998 | 11/1976 | Banz et al. | 271/167 |

FOREIGN PATENT DOCUMENTS

| | | | |
|---|---|---|---|
| 2507218 | 9/1976 | Fed. Rep. of Germany | 271/270 |

*Primary Examiner*—Robert W. Saifer

*Attorney, Agent, or Firm*—Shoemaker and Mattare, Ltd.

[57] ABSTRACT

A top-load, bottom-feed friction feeder which includes a power source having connected thereto a main feed wheel and an eccentric wheel. A stone wheel is located adjacent the main feed wheel. The stone wheel can be adjusted and the feeder can continuously feed pieces which have a wide variety of sizes, stocks and orientations.

13 Claims, 6 Drawing Figures

PAPER FEEDER

BACKGROUND OF THE INVENTION

The present invention relates in general to paper feeders, and, more particularly, to friction-type paper feeders.

Friction feeders are used to handle a wide variety of materials, such as paper, mail pieces, envelopes, and the like.

Such feeders often become jammed when a piece of paper having an odd thickness, size, or orientation is introduced thereinto. Such jamming requires the feeder to be shut down, thereby causing losses in both money and time. Therefore, there is need in the art of a friction feeder capable of accommodating pieces having a wide variety of thicknesses, sizes, stocks and orientations while still maintaining a continuous, uninterrupted operation.

A further drawback of presently known friction feeders results during adjustments to the feeder. Such adjustments in known feeders are not precise and overtravel of adjusted parts is often possible. Such overtravel results in undue wear to the parts of the feeder. Thus, a need exists for a feeder which will permit precise adjustments thereto while preventing overtravel of the adjusted parts. Furthermore, adjustments in known feeders often cause distortion of the pieces being fed thereby causing further jamming problems. Thus, there is need for a feeder which can be adjusted without causing undue distortion of pieces being fed by the device.

Other drawbacks to presently know feeders include lack of: variability, adaptability and precision. Thus, there is need for a friction feeder which is accurately adjustable, adaptable for handling multiple pieces of paper of varying thicknesses and which permits precise adjustment of the mechanism.

SUMMARY OF THE INVENTION

The feeder embodying the teachings of the present invention readily accepts pieces of paper having a wide variation in size, mix and thicknesses.

The feeder includes a motor which is connected to a main paper feed wheel assembly and to an eccentric wheel assembly. The motor drives these two wheel assemblies. The eccentric wheel assembly includes an eccentrically mounted wheel which contacts a packet of papers situated in a main feed tray. The eccentric wheel contacts the papers from the bottom and distorts the packet to define a bulge therein near the forward, or leading edge (as defined by the paper flow direction) thereof. The lowermost paper in the packet is forced by the eccentric wheel forward out of the packet toward the feed wheel assembly.

The main paper feed wheel assembly is located adjacent a stone wheel assembly which is housed in a paper stop assembly. An adjustment assembly adjusts the size of the gap established between these two wheel assemblies, and this gap between the stone and the main feed wheel may be set using a single control linking both sides of an adjustable assembly. Paper from a feed tray is impulsed into the gap between the main feed and stone wheels by action of the eccentric wheel. The eccentric and main drive wheel assemblies also include sprockets or pulleys on the eccentric and main drive wheel assemblies, a sprocket on the drive means, and a chain or belt connecting the sprockets or pulleys together.

The main feeding action results from the interaction of the main feed roll assembly and the eccentric rubber wheel assembly. Both are driven by the drive motor, but the eccentric rubber wheel shaft turns at least twice as fast as the main feed wheel at any given motor speed. The distance between the two feed wheels corresponds roughly to the length of the minimum size piece to be fed. In the preferred embodiment, this is about 3 inches. The action of the eccentric wheel accomplishes several functions. First, it continually raises the pile of material, jogging it against the paper stop; and secondly, it acts to transport the bottom piece against the main feed wheel where the piece passes through the gap between the stone and the feed wheel into whatever device with which the feeder is being used. The eccentric also, in raising the pile, forces the lead edge of the bottommost piece under the stone. Without this action, the lead edge of the bottommost piece will catch on the stone, causing feeding to stop or become interrupted. The main feed wheel is mounted on a one-way bearing allowing the piece to be accelerated by the unit into which it is fed. This feature is also useful in clearing jams, as the jammed piece may be pulled out while the feeder is turned off.

The action of the rubber eccentric wheel in controlling the pile also contributes to two other desirable features. A random intermix of pieces, sizes and stocks may be fed through a fixed gap. It is desirable to attach the feeder to a shredder, accommodating $\frac{1}{4}$ inch of paper at a time. By setting the gap between the feed wheel and the stone to $\frac{1}{4}$ inch, a miscellaneous collection of forms can be fed. The orientation of pieces in the feeder is far less critical than in those friction feeders embodying the teachings of the prior art. The presently disclosed unit does not depend on having the butt or folded edge presented to the feed wheel first.

Registration of the pieces is accomplished through the positioning of side guides and the wide stone/wheel dimensions. Correct adjustment of the stone on its adjusting brackets also aids in registration by guaranteeing that the gap between the stone and the main feed wheel is uniform over all dimensions. Once this parallelism is obtained, it is maintained through the stops on the threaded rods and the positioning of the locking collars on the adjusting rods.

The feeder of the present disclosure is a compact unit, thus allowing a wide variety of pieces to be fed singly. The unit will singly feed pieces from a single sheet and thickness to $\frac{1}{4}$ inch. Pieces can vary in width from 3 to 18 inches.

The feeder of the present invention thus is variably adaptable and precise according to the following discussion:

- Variability—The presently disclosed feeder is fully and accurately adjustable to handle single pieces varying in thickness from a single sheet to $\frac{1}{4}$ inch. Pieces will be fed singly without doubles, misfeeds or jams.
- Adaptability—By opening the presently disclosed feeder up to its full capacity, multiple pieces of varied thickness may be fed without jamming. This feeder may be used in this mode in-line with a shredder, for example.
- Precision—The adjusting mechanism on the presently disclosed feeder allows very precise setting of of dimension between the feed wheel and the stone.

By accurately controlling this distance, wear to the wheel is reduced and feeding accuracy is increased.

OBJECTS OF THE INVENTION

It is, therefore, a main object of the present invention to provide a paper feeder capable of accepting papers having a wide variety of orientations.

It is another object of the present invention to provide a paper feeder which will accept a wide variety of paper pieces.

It is a further object of the present invention to provide a paper feeder wherein a paper nipping gap is easily and precisely adjusted.

It is yet another object of the present invention to provide a paper feeder wherein movements of a paper nipping gap setting device does not cause distortion of the paper packet.

It is still another object of the present invention to provide a paper feeder capable of accepting a random intermix of paper pieces.

It is yet a further object of the present invention to provide a paper feeder capable of accommodating paper pieces which are randomly oriented.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
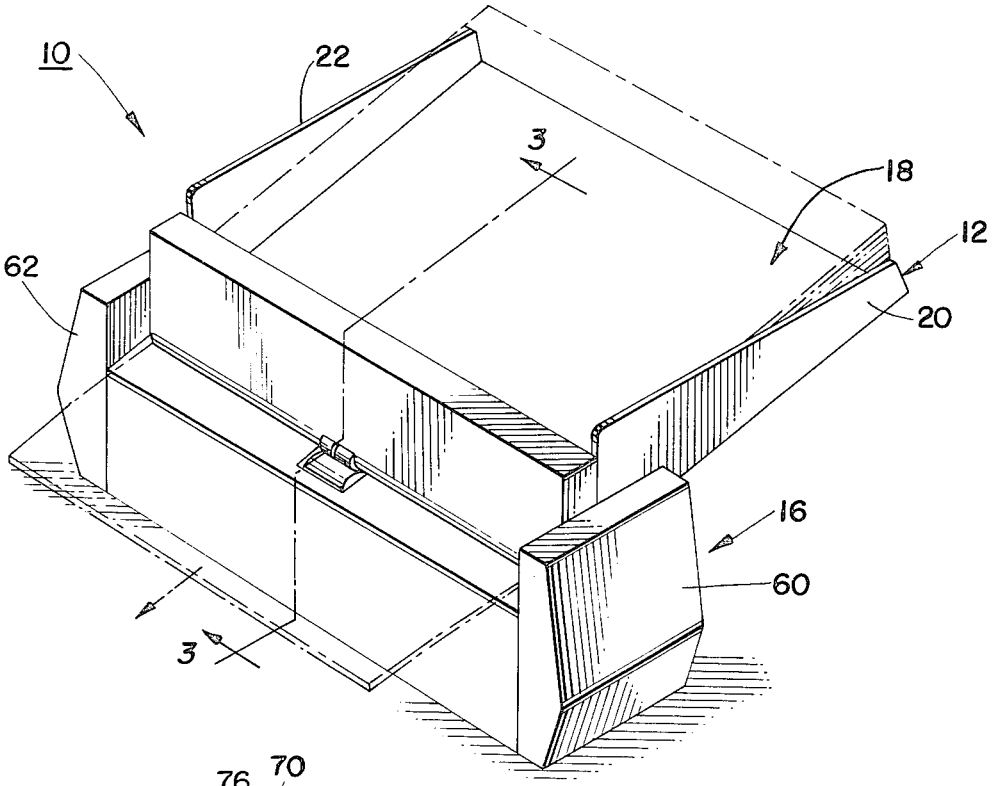
FIG. 1 is a perspective showing the paper feeder embodying the teachings of the present invention.
Figure 2:
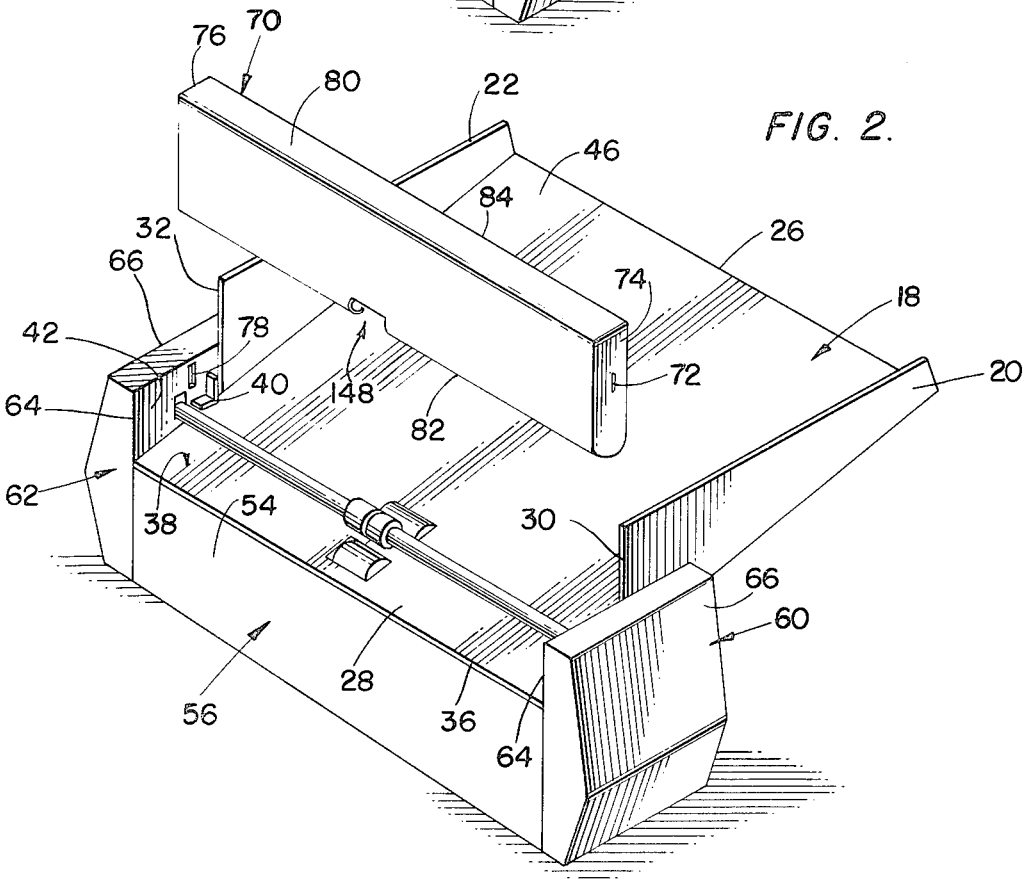
FIG. 2 is an exploded perspective showing the paper feeder embodying the teachings of the present invention.

Shown in FIG. 1 is a feeder 10 of the top-load, bottom-feed variety for feeding papers, or the like, to other machines, such as copiers, collators, shredders, or the like. Papers, mail, envelopes and the like are accommodated by feeder 10. The feeder 10 includes a paper tray 12 removably locked onto base 16 and having a web section 18 and a pair of side guides 20 and 22 integrally attached to the web section. The tray is sloped from the distal end 26 downwardly to proximal end 28, and rear edges 30 and 32 of the side guides are spaced from rear edge 36 of the web to define an apron section 38. As best shown in FIG. 2, a pair of tray support brackets 40 (one shown) are mounted on inner surface 42 of the base, and contact upper surface 46 of the tray web to releasably attach the tray to the base. A catch flange can be located on rear end edge 36 of the tray web to engage rear outer surface 54 of the base rear 56 and thereby maintain the tray in the desired orientation on the base. As shown in FIGS. 1 and 2, the base 16 includes a pair of side sections 60 and 62 each having an inner portion 64 and an outer portion 66 which can be shaped as shown in FIGS. 1 and 2 or can assume any other suitable shape.

A paper stop assembly 70 is detachably mounted to the base 16 by tabs 72 on ends 74 and 76 thereof interfittingly accommodated in elongate slots 78 defined in the base inner portions 64. The tabs 72 are elongate and of less width than the longitudinal extent of the slots so the tabs can slide longitudinally of those slots for a purpose to be discussed hereinafter. The paper stop assembly 70 also includes a top end portion 80, a bottom portion 82 and a front portion 84 which serves as a jogging board for papers located on the tray 12. A latching device 90 is also included in the paper stop for releasing the stop from the base 16 by operation thereof. The latch can operate the tabs 72 to retract those tabs out of engagement with the slots to thereby free the stop assembly. Support brackets 40 and a channel bracket 94 are also included in the preferred embodiment of the feeder 10 to further support the paper stop assembly and the tray respectively.

Figure 3:
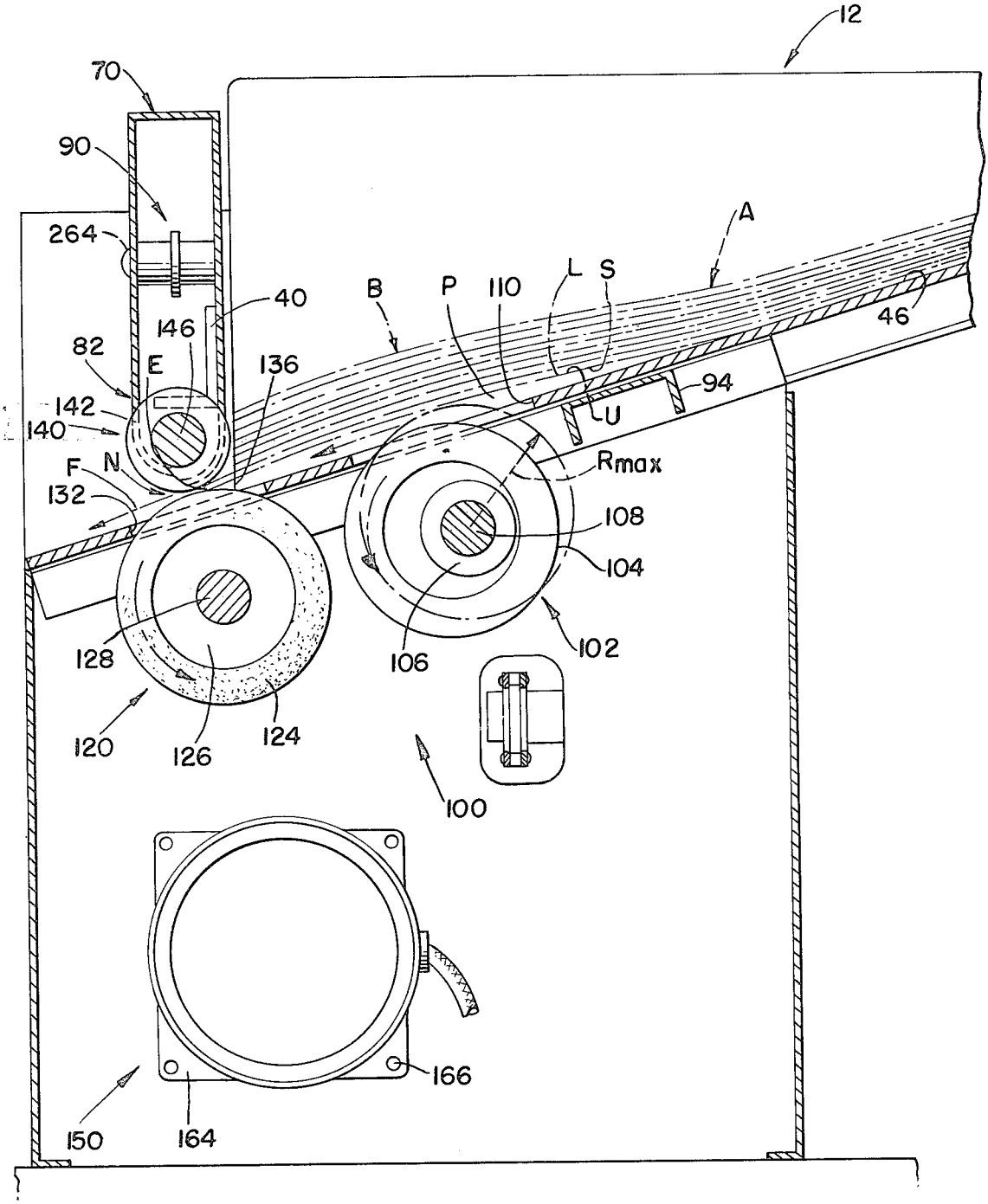
FIG. 3 is a view taken along line 3—3 of FIG. 1.

A paper feed means 100 is best shown in FIG. 3. A packet of papers A is contained within the feed tray 12 in a stacked configuration to have a lowermost sheet L having an upper surface U and a lower surface S. A superjacent sheet of paper contacts upper surface U and the lower surface S contacts the tray web section. The tray side guides can be adjustable to accommodate various widths of papers if desired. It is noted that the feeder 10 is top loaded while the feeding is from the bottom, thereby permitting continuous operation.

The paper feed means 100 is shown in FIG. 3 to include an eccentric wheel assembly 102 having an impellar surface 104 encircling a hub 106 which is mounted on a drive shaft 108 for rotation therewith. The hub 106 is eccentrically mounted on the drive shaft so that rotation of the drive shaft imparts eccentric rotational movement to the impellar surface 104. The impellar surface extends through an opening 110 defined in the tray web section and contacts a paper lower surface S. As shown in FIG. 3, the preferred embodiment of the feeder includes an impellar surface having a rubber-like composition. The impellar surface of the eccentric wheel 102 lifts a portion of the papers upwardly from the tray web during a portion of the rotation of that wheel. A pocket P is thus defined between the lower surface S of the paper L and the web. The hub is mounted on the drive shaft so that the maximum "radius" R-max of the eccentric wheel defines a pocket P of the desired size. The size of the pocket is set according to paper, paper feed, and the like. During gap defining contact between the eccentric wheel and the paper, a bulge B is defined in the sheaf of papers so that leading edges E thereof are slightly downwardly slanted. During operation of the eccentric wheel, the packet of papers is continually jogged against the stop assembly. Thus, the feeder 10 will accommodate pieces of paper without regard to the orientation of those pieces in the paper tray.

A main paper feed wheel assembly 120 is located just downstream (in the paper flow direction) of the eccentric wheel and includes a paper advancing section 124 encircling a hub 126 which is mounted on a drive shaft 128 for rotation therewith. The advancing section 124 is concentrically mounted on the hub, and the hub is concentrically mounted on the drive shaft to define uniform rotational movement. The advancing section protrudes through an aperture 132 defined in the tray web section to contact the top surface of the lowermost sheet of paper near the leading edge E thereof as that sheet emerges from the tray via a paper feed slot 136 defined between the paper stop assembly lower end 82 and the tray web section upper surface 46 by spacing that lower end 82 vertically upward from the upper surface 46. The feed slot is sized to permit only one paper sheet at a time to pass therethrough. The remainder of the sheets are jammed against the inner surface of the paper stop as shown in FIG. 3.

A stone wheel assembly 140 is located above the paper feed wheel and includes a paper nip defining section 142 which can be concentrically mounted on a hub which is concentrically mounted on a drive shaft 146 for rotation therewith. The stone wheel is positioned to define a nipping gap N between the nip section 142 of the stone wheel and the advancing section 124 of the main drive wheel. The size of the gap N is set according to paper thickness, and the like. The nip section 142 contacts the lowermost paper sheet on the top surface thereof near the leading edge E thereof. As shown in FIG. 3, the stone and the main drive wheel assemblies have the centers thereof aligned to be slanted with respect to the vertical. The slanted nature of these centers compliments the slant of edge E with respect to the vertical as that edge emerges from the paper feed slot 136 so that paper jamming is minimized or avoided entirely. As shown in FIG. 2, the stone wheel assembly is accommodated in a notch 148 defined in the paper stop assembly 70.

The just-discussed wheel assemblies are synchronously operated so that the eccentric wheel lifts the paper packet and drives a piece of paper through the paper feed slot into the gap N, and the main drive and stone wheels are operated to smoothly remove that paper from the feed slot in the direction indicated by the arrow F in FIG. 3. The pocket P and gap N as well as the orientation of the wheels are all set to provide smooth, non-jamming paper feed during operation of the feeder 10. The location and orientation of the wheel assemblies with respect to each other, with respect to the feed tray, with respect to the feed slot, as well as the sizes of these assemblies relative to each other and relative to the other elements of the feeder 10 are all selected to establish the smooth, non-jamming feed of the paper at various paper dimensions and feed speeds from the feeder 10. The considerations involved in selection of such dimensions and positions will occur to those skilled in the art, and will therefore not be delineated herein.

Figure 4:
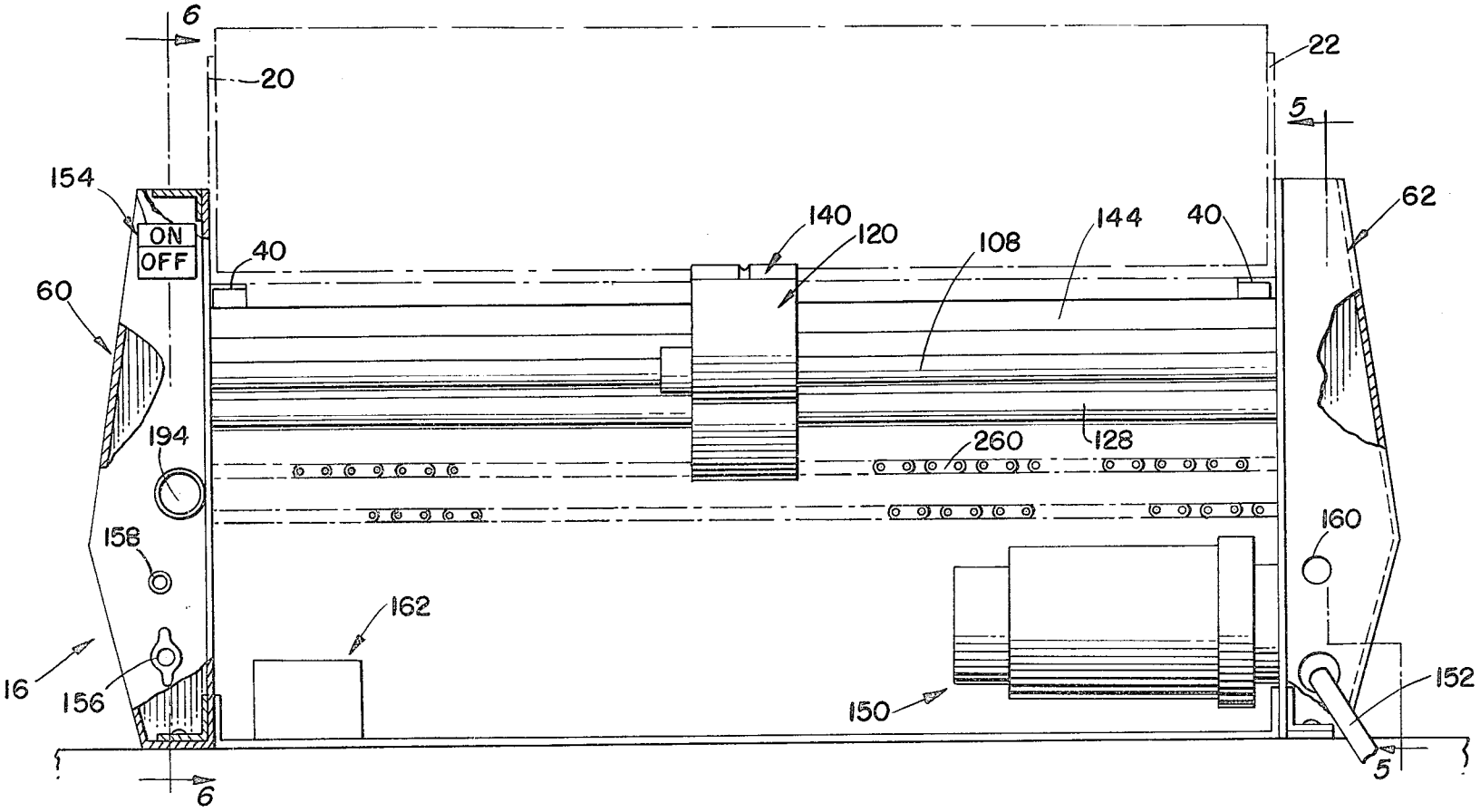
FIG. 4 is an end elevation view of the paper feeder embodying the teachings of the present invention.

A motor 150 is used to drive the eccentric and main drive wheel assemblies and is powered via power cord 152, controlled by on-off switch 154, and regulated by adjusting knob 156. A power-on indicator 158 is mounted on the base section as is fuse 160 as shown in FIG. 4. A transformer assembly 162 is mounted within the base 16 and serves the usual purpose of controlling and regulating the motor 150. The feeder 10 is therefore a variable speed unit. The motor can be mounted within the base on a motor mount 164 and attached to that base by fasteners, such as screws 166, shown in FIG. 3. The motor can be a DC motor which acts through a variable transformer and a standard AC rectifier circuit. In one embodiment, motor 150 has a range of operation of from 0 to 183 rpm.

Figure 5:
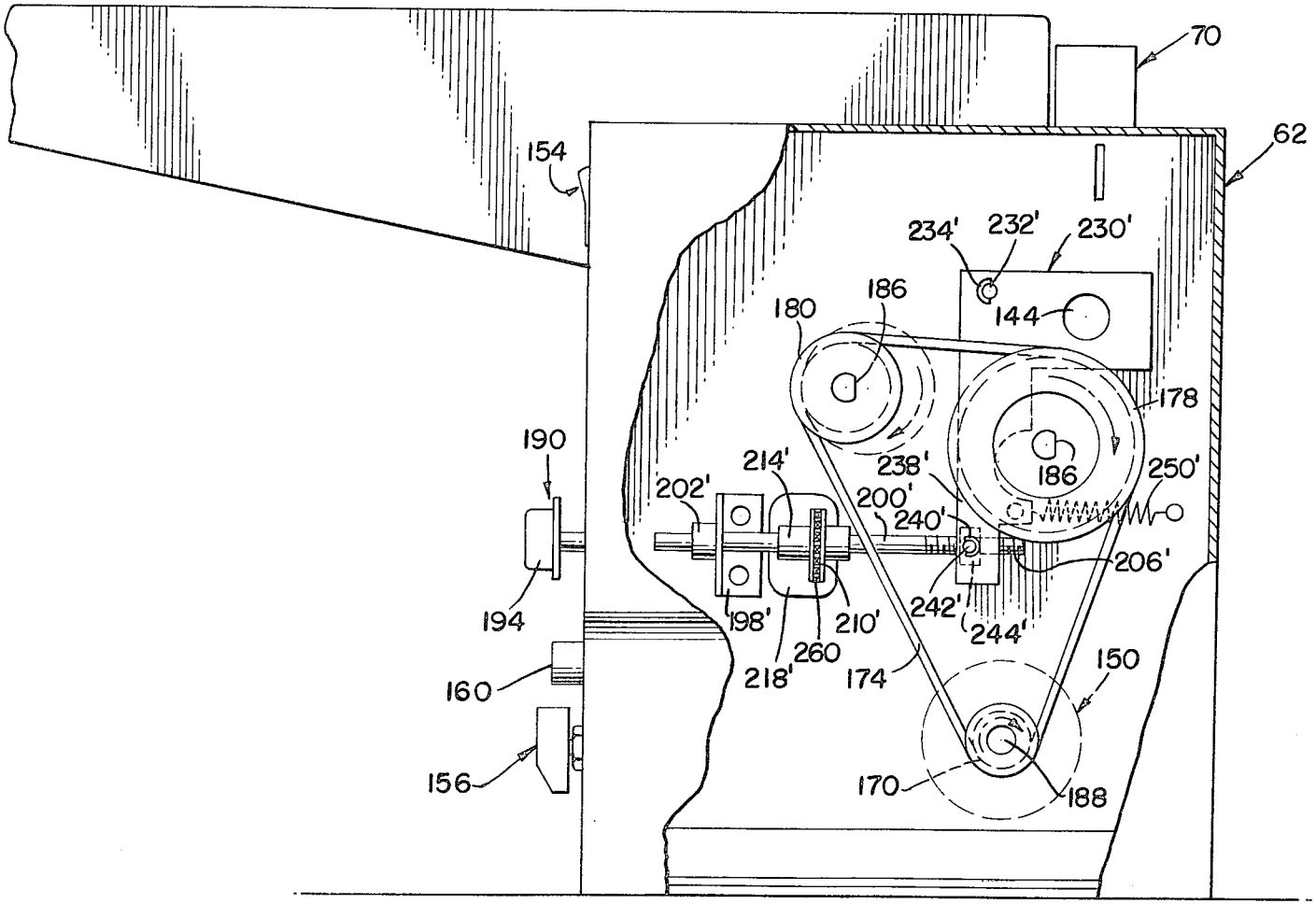
FIG. 5 is a view taken along line 5—5 of FIG. 4.

As shown in FIG. 5, the motor 150 includes a sprocket wheel 170 around which a chain 174 is trained. The chain 174 is also trained around sprocket wheels 178 and 180 on the drive wheel assembly drive shaft and the eccentric wheel assembly drive shaft respectively. Each of the drive shafts is attached to the sprocket wheels and has a flat area 186 thereon which drivingly engages the associated wheel. Thus, when motor output shaft 188 rotates clockwise, the eccentric wheel and main drive wheel are both rotated clockwise at angular velocities determined according to the usual rules of mechanics. Of course, belts, or such other drive means can be substituted for the chain 174 without departing from the scope of the present disclosure.

Figure 6:
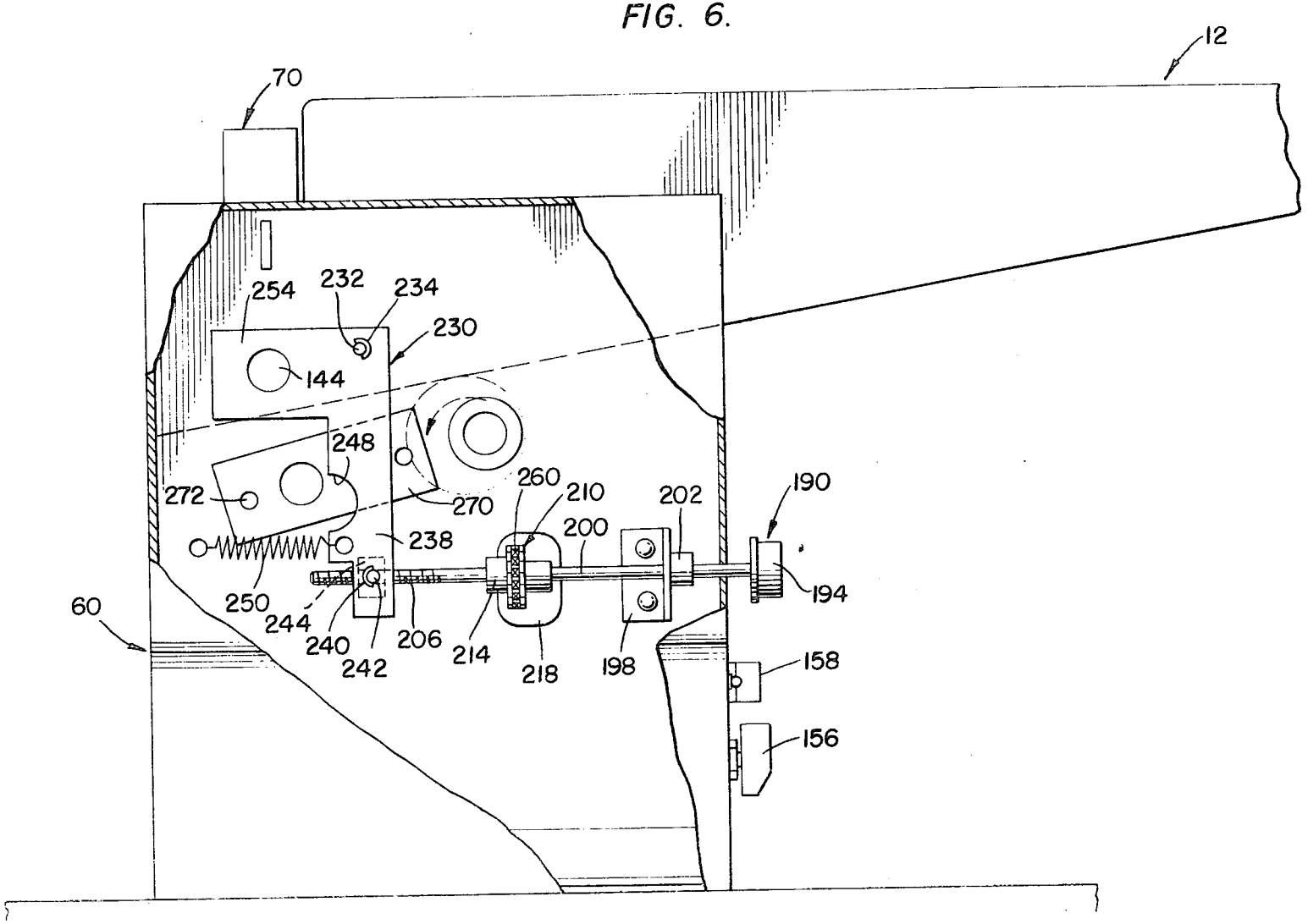
FIG. 6 is a view taken along line 6—6 of FIG. 4.

As best shown in FIGS. 4, 5 and 6, the position of the eccentric wheel assembly is adjusted using adjusting means 190 which is shown in FIG. 5 to include a single adjusting knob 194. As shown in FIG. 6, the adjusting means includes a mounting bracket 198 which rotatably receives a first adjusting rod 200 having a collar 202 thereon to control axial movement thereof. The knob 194 is mounted on one end of the rod 200, and the other end of the rod 200 has a plurality of threads 206 defined thereon. A sprocket 210 is connected to the rod near the mounting bracket by a bearing 214 and is mounted on the base side section 60 by a mounting bracket 218.

The adjusting rod 200 controls the position of one end of the stone wheel drive shaft 146 via a bell crank 230. The bell crank 230 is L-shaped and is pivotably mounted on the base side section 60 by a pivot stub shaft 232 which is connected to the inner surface of the base side section 60. The stub shaft is received in an aperture and a hood 234 is located next to that aperture. The bell crank pivots about the axis defined by the stub shaft.

A lower leg 238 of the crank 230 has a mounting hood 240 on an inner surface thereof and a stub shaft 242 is received in an aperture defined through the leg 238. A threaded connector 244 is mounted on the stub shaft 242 and threadably receives the threads 206 of the adjusting rod 200. Thus, as the adjusting knob 194 is rotated, the threaded engagement of the rod 200 and the connector 244 causes the lower leg 238 of the crank 230 to move toward or away from the knob axially of the rod 200. The movement of the leg 238 is yieldably resisted by a spring 250 mounted at one end to an inner surface of the base side section, and at the other end to the lower leg 238. The movement of the lower leg 238 causes the crank 230 to pivot about the stub shaft 232 in either the clockwise or counterclockwise direction, according to the direction of movement of the lower leg. A notch 248 is defined in the lower leg to accommodate the drive shaft of the main feed wheel.

The stone wheel drive shaft 144 is connected at one of the outer ends thereof to upper leg 254 of the bell crank, and the pivotal movement of the crank about the stub shaft 232 causes this upper leg 254 to move up and down. The up and down movement of the upper leg moves the stone wheel drive shaft up and down, thereby moving the stone wheel up and down. The up and down movement of the stone wheel alters the size of the gap N as the main drive wheel is fixed. In this manner, the size of the gap N is adjusted while turning only a single adjusting knob. The out-of-vertical relationship between the centers of the stone and main drive wheel permit the bell crank pivotal movement to adjust the gap.

To relay the movement of the adjusting knob to the other end of the stone wheel drive shaft so that uniform movement of the stone wheel can be obtained, an adjusting rod 200' is included on the other side of the feeder. As best shown in FIG. 5, the right side of the feeder includes adjusting rod 200' mounted on the base side section 62 by a mounting bracket 198' which rotatably receives that rod, and a collar 202' is mounted on the rod 200' to control axial movement of the rod. One end of the rod 200' is free, and the other end of the rod has a plurality of threads 206' defined thereon. A sprocket 210' is connected to the rod near the mounting bracket by a bearing 214' and is mounted on the base side section 62 by a mounting bracket 218'.

The adjusting rod 200' controls the position of the other end of the stone wheel drive shaft 144 via a bell crank 230'. The bell crank 230' is L-shaped and is pivotably mounted on the base side section 62 by a pivot stub shaft 232' which is connected to the inner surface of the base side section. The stub shaft is received in an aperture and a hood 234' is located next to that aperture. The bell crank pivots about the axis defined by the stub shaft.

A lower leg 238' of the crank has a mounting hood 240' on an inner surface thereof and a stub shaft 242' is received in an aperture defined through the leg 238'. A threaded connector 244' is mounted on the stub shaft 242' and threadably receives the threads 206' of the adjusting rod 200'. As adjusting rod 200' is rotated in a manner to be described below, the threaded engagement between the rod and the connector 244' causes the lower leg 238' of the crank 230' to move axially of that rod. The movement of the leg 238' is yieldably resisted by a spring 250' mounted at one end to an inner surface of the base side section 62, and at the other end to the lower leg 238'. Movement of the lower leg 238' causes the crank 230' to pivot about the stub shaft 232'.

A chain 260 is trained around the sprockets 210 and 210' to drivingly interconnect those sprockets. Thus, rotation of the adjusting rod 200 rotates sprocket 210, which rotates the chain 260. The chain 260 drives sprocket 210' which then rotates the adjusting rod 200'. As is the case with adjusting rod 200, rotation of adjusting rod 200' moves the crank lower leg 238' due to the threaded connection between the rod and the connector 244'. Movement of the lower leg 238' translates into up and down movement of the upper leg 254' of the bell crank 230' to which is attached the other end of the stone wheel drive shaft. The bell cranks 230 and 230' move in unison, and thus up and down movement of the stone wheel is uniformly set from both ends of the stone wheel drive shaft 144. Thus, gap N is uniform across the width of the stone wheel assembly. It is noted that the threaded adjustment rods provide very fine, precise adjustments to eliminate doubles even in the thinest stocks.

Through action of the bell cranks 230 and 230', the opposite ends of the stone/paper stop assembly may be set and locked independently to guarantee parallelism between the feed roll and the stone. In the preferred embodiment, the main feed roll is mounted on a one-way bearing allowing acceleration of the piece from the feeder and easy clearing of jams, and the feed mechanism advancing section 124 may contain rubber or like material, and the eccentric roll impulsing section 104 also may contain rubber or like material that continually advances the pile of paper, jogging the pile against the perpendicular paper stop assembly at the front end of the feeder. Also, in the preferred embodiment, rotation of the eccentric wheel is more rapid than rotation of the main feed wheel.

The gap N is thus adjusted using an adjusting assembly which includes the left and right adjusting brackets 230 and 230', the adjusting rods 200 and 200', the sprockets 210 and 210', the adjusting chain 260, and the adjusting knob 194. Movement of the adjusting rods only occurs until the end of the threads 206 or 206' reaches the stub shaft. It is noted that alternative to the threaded mounts 244 and 244', threaded stub shafts can be used with the adjusting rods threadably engaged with those threaded stub shafts. The collars 202 and 202' work in conjunction with the springs 250 and 250', respectively, to maintain the adjusting rods in position, and, thus, limits of adjustment are set by fixed stops thereby eliminating overtravel and unnatural feed wheel wear. In the preferred embodiment of the feeder 10, clockwise movement of the adjusting knob moves the bell crank lower legs toward that knob to decrease the distance between the stone wheel and the main feed wheel, with the opposite operation occurring during counterclockwise movement of the adjusting knob.

It is further noted that the entire paper stop assembly slides down as the stone shaft is lowered as a result of the engagement of tongues 72 in the slots 78. The slots allow the paper stop to be continually perpendicular to the base of the feeder 10, and thus, movements of the stone up and down do not cause distortion of the pile. The paper stop can include a slot 264 through which the latch 90 extends. Vertical movement of the paper stop can thus be controlled using the slot 264.

In the preferred embodiment of the feeder 10, the range of adjustment is from 0 to approximately $\frac{1}{4}$ inch, allowing the feeder to accommodate pieces that vary from a single sheet up to thick documents or booklets. The threaded adjustment rods allow this adjustment to be made with precision, easily eliminating doubles and/or misfeeds.

As best shown in FIG. 6, the main drive wheel shaft has the opposite ends thereof connected to the base side sections by mounting plates, such as mounting plates 270 attached to the side section 60 by fasteners, such as screws 272, or the like.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A friction feeder comprising:

a base;

a feed tray on said base;

a paper stop assembly releasably mounted on said base;

a main feed wheel assembly mounted on said base adjacent said feed tray;

a stone wheel assembly mounted on said base to be adjacent said feed wheel assembly for accepting paper from said feed tray to move such paper from said feed tray, said stone wheel assembly including a mounting shaft;

an eccentric wheel assembly mounted on said base adjacent said feed tray and including a drive shaft mounted on said base and a wheel eccentrically mounted on said drive shaft to contact paper contained in said feed tray in a manner which lifts a portion of that paper from said feed tray to define a bulge in that paper and cause a leading edge of such paper to tilt with respect to a vertical orientation;

a drive means connected to said eccentric wheel assembly and to said main feed wheel assembly for driving those two assemblies; and adjusting means for adjusting the location of said stone wheel assembly with respect to said main feed wheel assembly to define a gap between such assemblies of a predetermined size, said adjusting means including a crank and an adjusting rod on each end of said stone wheel mounting shaft and connecting means connecting said adjusting rods together so that rotation of one adjusting rod causes rotation of the other adjusting rod.

2. The friction feeder of claim 1 wherein said adjusting means includes a crank connecting said adjusting rod to said stone wheel assembly.

3. The friction feeder of claim 2 wherein said stone wheel assembly further includes a wheel mounted on said mounting shaft.

4. The friction feeder of claim 2 wherein said crank is a bell crank and a spring attaches one leg of said crank to said base.

5. The friction feeder of claim 1 wherein said connecting means includes sprocket wheels on each adjusting rod and a chain connecting said sprocket wheels together.

6. The friction feeder of claim 5 wherein said paper stop includes tongues mounted in slots defined in said base.

7. The friction feeder of claim 1 wherein said paper stop has a portion thereof spaced from said tray to define a paper feed gap through which paper moves, said eccentric wheel causing a pile of papers to be jogged against said paper stop adjacent said paper feed gap during rotation of said eccentric wheel.

8. The friction feeder of claim 7 wherein a line passing through the centers of said main feed and stone wheel assemblies is at an angle with respect to the vertical so that a paper feed by said eccentric wheel assembly moves readily between said feed wheel and stone wheel assemblies.

9. The friction feeder of claim 1 wherein the feeder is a top-loading, bottom-feeding feeder.

10. The friction feeder of claim 1 wherein said drive means has a variable speed.

11. The friction feeder of claim 1 wherein said adjusting rods have threads on one end thereof and said cranks have threaded connections thereon for receiving said adjusting rod threaded ends.

12. The friction feeder of claim 1 wherein said feed tray includes movable sides.

13. The friction feeder of claim 1 further including a latch connecting said paper stop assembly to said base.

* * * * *